US005136794A

United States Patent [19]

Stampacchia et al.

[11] Patent Number: 5,136,794

[45] Date of Patent: Aug. 11, 1992

[54] SKI BOOT

[75] Inventors: Marcello Stampacchia, Treviso; Stelio Simonetti, Noale; Cristiano Benetti, Postioma, all of Italy

[73] Assignee: Lange International S.A., Fribourg, Switzerland

[21] Appl. No.: 669,049

[22] Filed: Mar. 14, 1991

[30] Foreign Application Priority Data

Apr. 24, 1990 [CH] Switzerland ..... 1387/90

[51] Int. Cl.[5] ..... A43B 5/04

[52] U.S. Cl. ..... 36/117; 36/120; 36/121

[58] Field of Search ..... 36/117, 118, 119, 120, 36/121

[56] References Cited

U.S. PATENT DOCUMENTS 3,543,421 12/1970 Ader ..... 36/121
4,142,307 3/1979 Martin ..... 36/117
4,265,034 5/1981 Salomon ..... 36/121
4,499,676 2/1985 Chalmers, II ..... 36/117
4,739,563 4/1988 Guggenberger et al. ..... 36/117
4,899,469 2/1990 Hilgarth ..... 36/120
5,031,341 7/1991 Paris et al. ..... 36/120

*Primary Examiner*—Paul T. Sewell
*Assistant Examiner*—M. D. Patterson
*Attorney, Agent, or Firm*—Kane, Dalsimer, Sullivan, Kurucz, Levy, Eisele and Richard

[57] ABSTRACT

Ski boot consisting of a lower part and of a shaft, in the form of a collar, which is articulated on the lower part and provided with at least one closing buckle. The shaft comprises, at the rear, a rocker which interacts with a stop which is integral with the lower part in order to lock the shaft in a position inclined forwards. The rocker is held in inactive position upon opening of the uppermost buckle by means of a cable and of a spring. Thus, the shaft does not come to be locked at the wrong moment during walking.

6 Claims, 6 Drawing Sheets

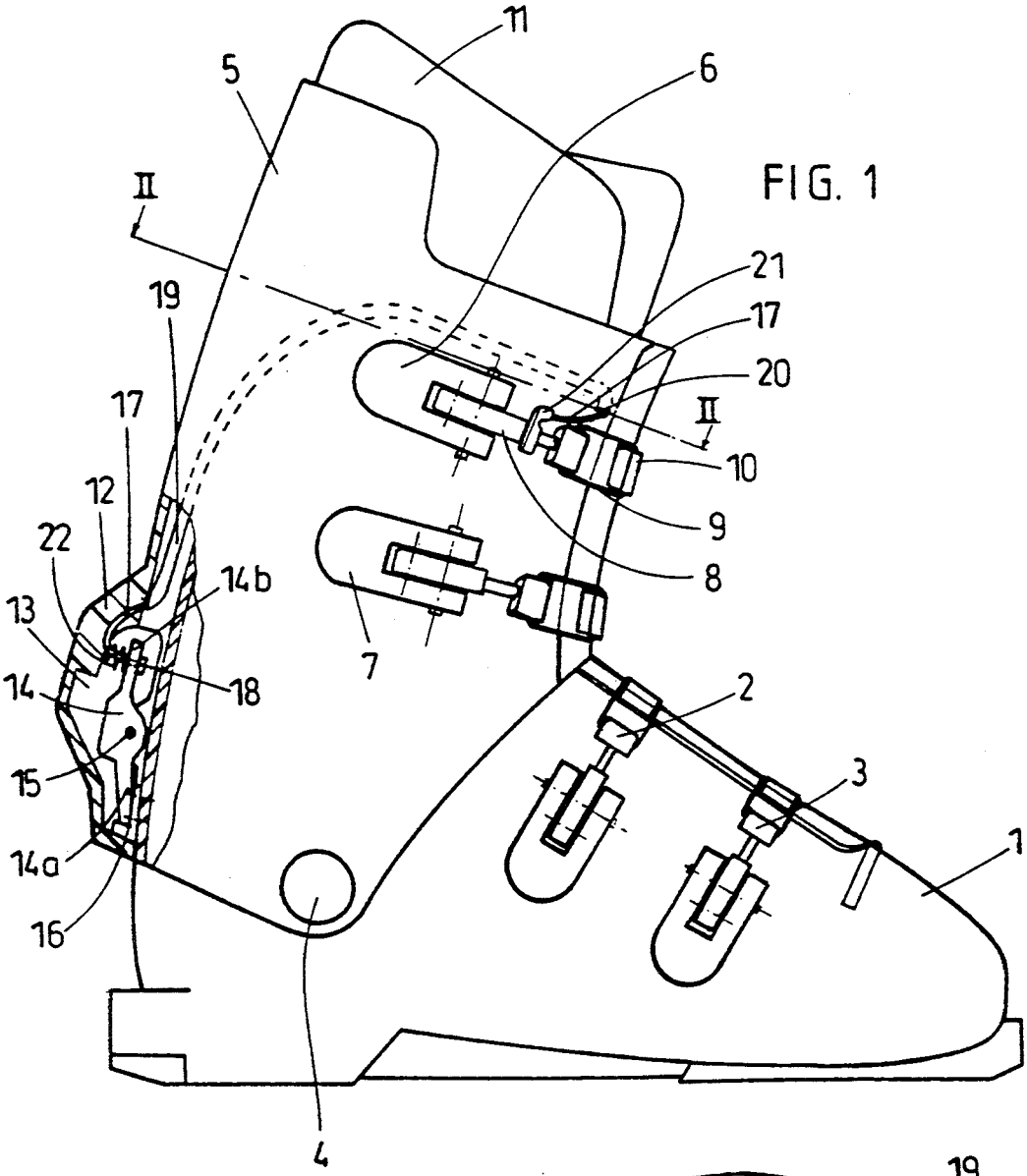
FIG. 1
FIG. 2
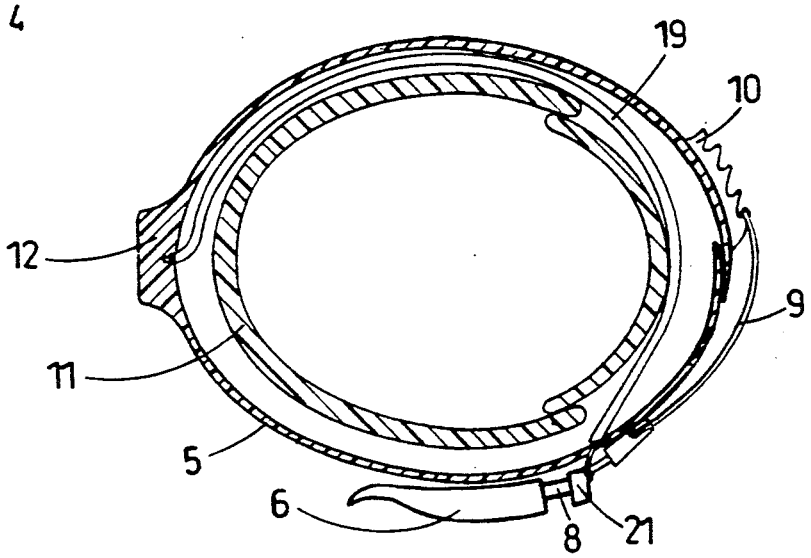

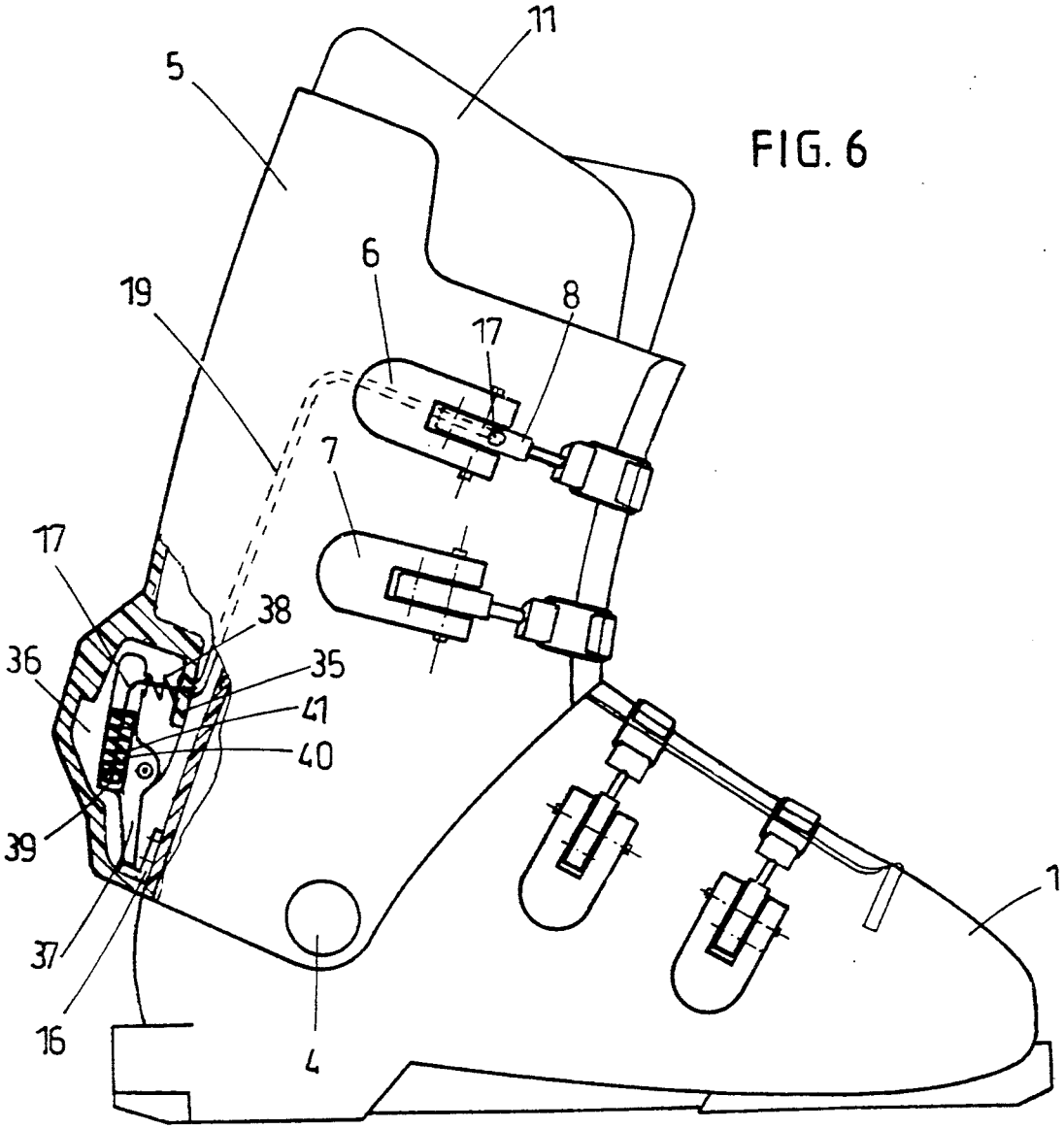
FIG. 6
FIG. 7
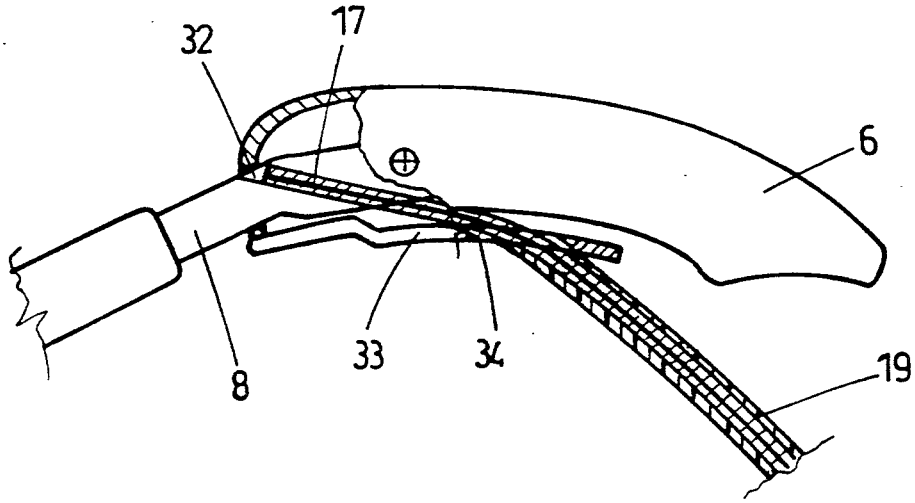

SKI BOOT

FIELD OF THE INVENTION

The present invention relates to a ski boot consisting of a lower part surrounding the foot and the heel and of a shaft, in the form of a collar, which is articulated on the lower part, provided with at least one closing and clamping buckle and comprises, at the rear, a rocker, one of the arms of which interacts with a stop which is integral with the lower part of the boot in order to hold the shaft in a descent position, inclined forwards, the shaft being capable of being freed by moving the rocker away from the stop.

PRIOR ART

Such a boot is known from the U.S. Pat. No. 4,499,676 and has been marketed by the Applicant, in particular under the name XL-SPORT. The skier, by simple pressure on the rocker, can move the latter away from its stop, which allows him to straighten the leg and thus to be in a comfortable position when he is not in the process of skiing. Simple bending of the leg locks the shaft again in the descent position. It is also convenient that the shaft can oscillate freely during walking. However, if the skier takes a long step or if he is walking on a slope, uphill, the natural bending of the leg in relation to the foot has the effect of locking the shaft at the wrong moment.

SUMMARY OF THE INVENTION

The aim of the invention is to overcome this disadvantage u by means which hold the shaft in the unlocked position as long as the skier so wishes, but without it being necessary to act directly on the rocker.

When stopping or walking, the skier generally unclamps his boots. The invention makes use of this operation of relaxation.

The ski boot according to the invention comprises means between the buckle for closing and clamping the shaft and the rocker which provide for the moving away of said rocker from the stop by the closing buckle.

These means preferably consist of a cable which acts directly on the rocker or on a mobile intermediate piece which itself acts on the rocker.

When the buckle for closing and clamping the shaft is closed, the rocker automatically comes to engage on its stop, as in the prior art. Opening the buckle for closing and clamping has the effect, however, of moving the rocker away from the stop and of holding it in this moved away position.

BRIEF DESCRIPTION OF THE DRAWINGS

The attached drawing represents by way of example two embodiments of the invention.

FIG. 1 represents a boot, the part of which comprising the rocker is represented in cross-section.

FIG. 2 is a view in cross-section along II—II in FIG. 1.

FIG. 6 represents a third embodiment in the locked position.

FIG. 7 is a detail of FIG. 6, showing the fixing of the cable to the buckle.

DESCRIPTION OF THE PREFERRED EMBODIMENTS

Figure 3:
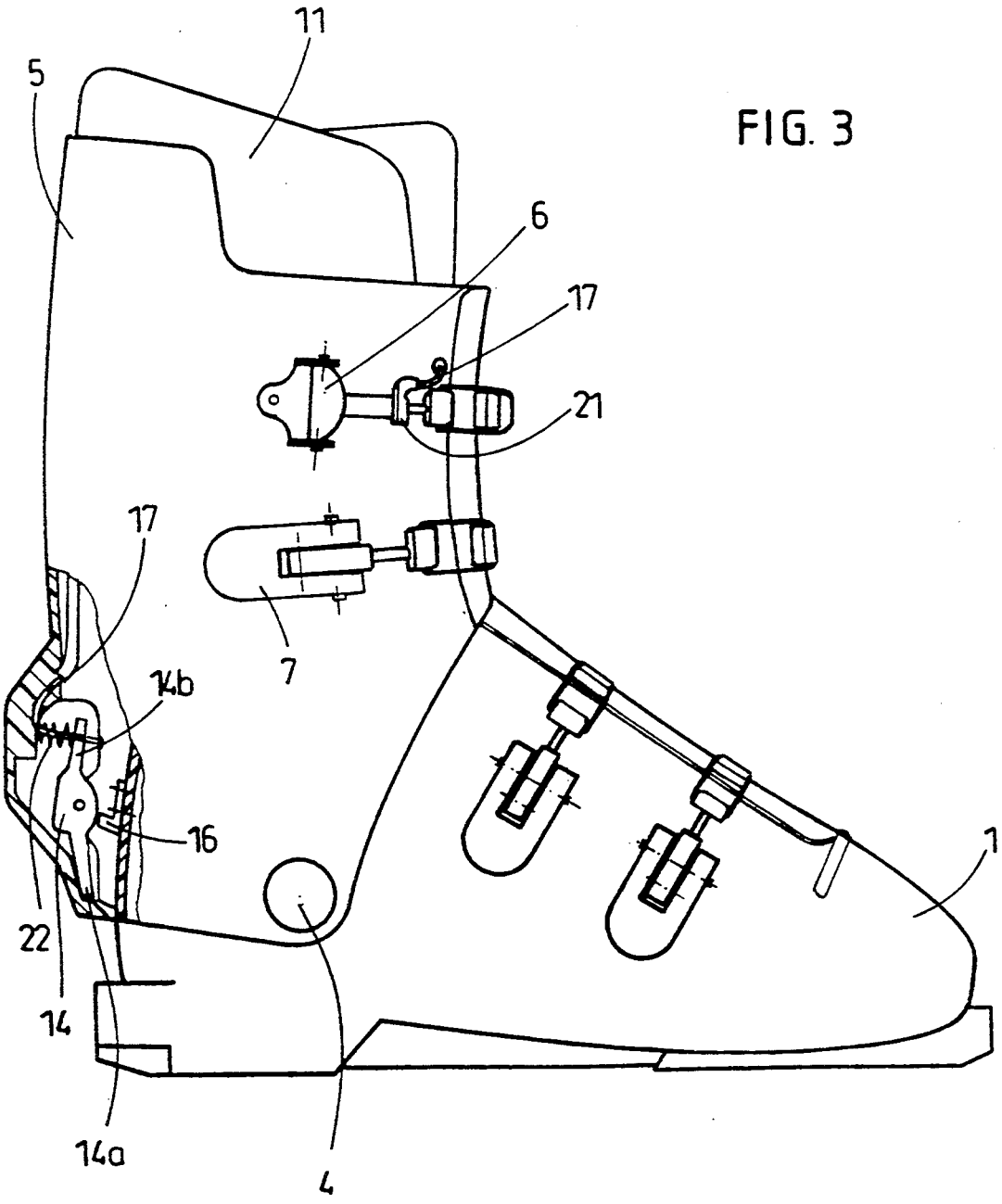
FIG. 3 represents the boot in FIG. 1 with the shaft in the freed position.

The boot represented in FIGS. 1 to 3 comprises a lower part 1 surrounding the foot and the heel, this part being of variable volume and clampable by means of two buckles 2 and 3. On this lower part 1, there is articulated about a pin 4 a shaft 5 in the form of a collar which is closable and clampable by means of two buckles 6 and 7. Buckles 2, 3, 6 and 7 consist, in known manner, of a tensioning lever which exerts traction, by means of a drawbar 8, on a rectangular buckle 9 which comes to engage on one of the notches of a multiple hook 10 which is fixed to the opposite flap of the shaft. The lower part 1 and the shaft 5 form a shell, on the inside of which an inner comfort boot 11 (FIG. 2) is arranged.

At the rear, the shaft 5 has, in its lower part, an enlargement 12 which delimits an internal housing 13, in which a rocker 14 is articulated about a transverse horizontal pin 15. The lower arm 14*a* of this rocker is intended to interact with a stop 16 which is fixed by means of rivets to the lower part 1 of the boot. In the closed and clamped position of the shaft 5, represented in FIG. 1, the arm 14*a* of the rocker 14 is held against the lower part 1 of the boot by a cable 17 which is provided with a head 18 which comes to bear against the upper arm 14*b* of the rocker. This cable 17 first passes through a hole made in the part 12 of the shaft, then into a sheath 19 which extends between the shaft 5 and the inner boot 11. The other end of this sheath 19 arrives opposite a hole 20 provided in the shaft 5 close to the buckle 9, that is to say in front of the drawbar 8. The other end of the cable 17 is fixed to the drawbar shaft and the arm 14*b* of the rocker 14, there is moreover arranged, around the cable 17, a spring 22 which works under compression.

When the skier wishes to rest or to walk, he unhooks the buckle 6. The shaft 5 is still held sufficiently by the buckle 7. Opening the buckle 6 has the effect of relaxing the traction on the cable 17. The spring 22 can then push back the arm 14*b* of the rocker 14, the arm 14*a* of which moves away from the stop 16. The shaft 5 can then be straightened in relation to the sole. The rocker 14 is held in this position by the spring 22 so that the shaft 5 can oscillate about its articulation 4 without the rocker 14 coming to engage on the stop 16 at the wrong moment.

When the skier closes the buckle 6 again, the shaft 5 of the boot can be either in the position represented in FIG. 1 or in a position close to that represented in FIG. 3. If the boot is in the position represented in FIG. 1, the rocker 14 comes to occupy directly the position represented in the figure under the effect of the traction exerted by the buckle 6 on the cable 17. If the shaft is in a position close to the position represented in FIG. 3, the end of the lower arm 14*a* of the rocker comes against the lower part 1 of the boot, that is to say under the stop 16. Consequently, when the skier bends his leg, the arm 14*a* of the rocker comes to abut against the edge of the stop 16. The deformation capacity of the plastic material constituting the shaft 5 and of the cable 17 between the buckle 6 and the rocker 14, and the considerable force exerted by bending the leg make it possible, however, for the arm 14*a* of the rocker to pass over the edge of the stop 16 to come to engage as represented in FIG. 1.

Figure 4:
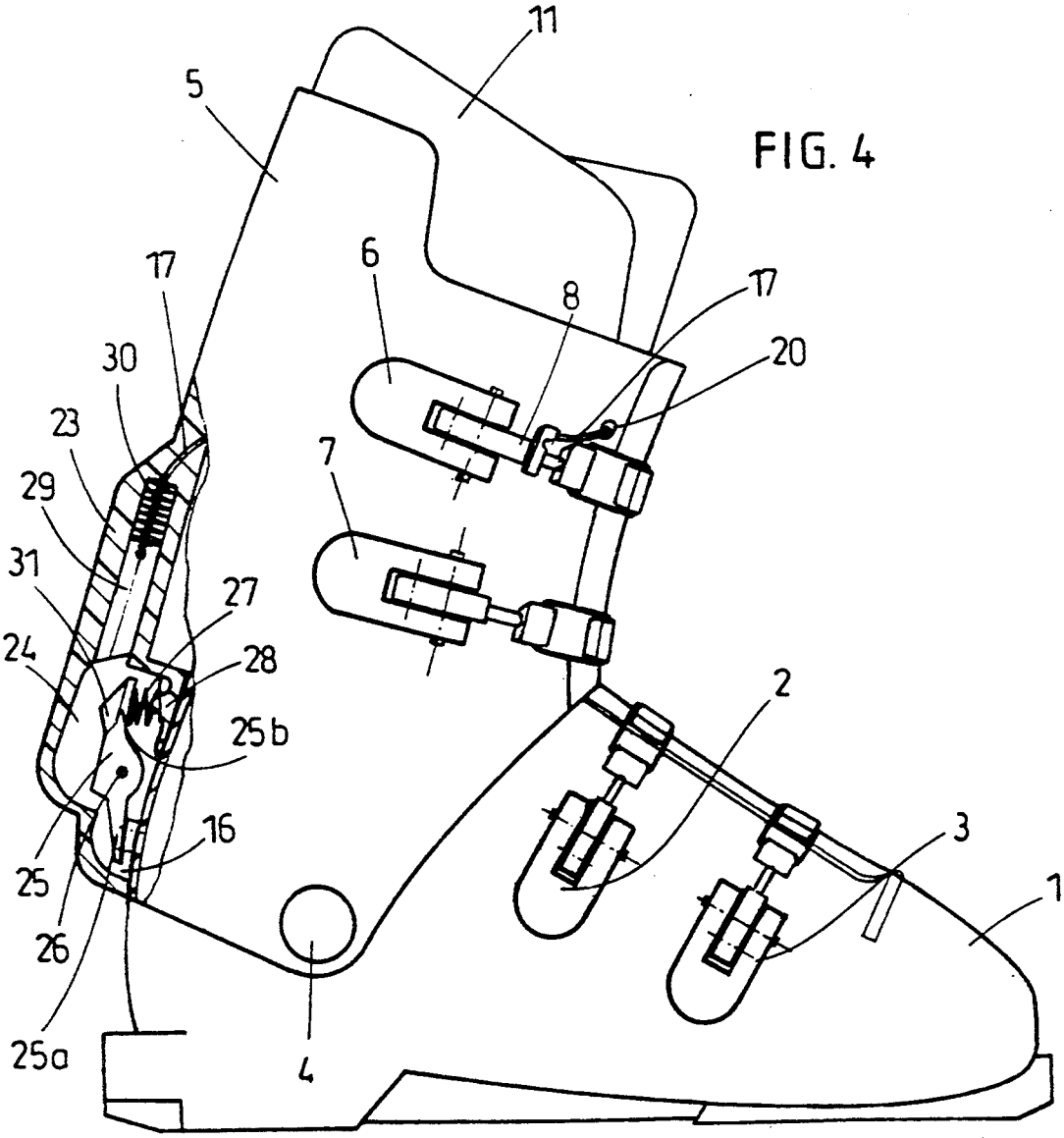
FIG. 4 is a view similar to that in FIG. 1 of a second embodiment, in the locked position of the shaft.
Figure 5:
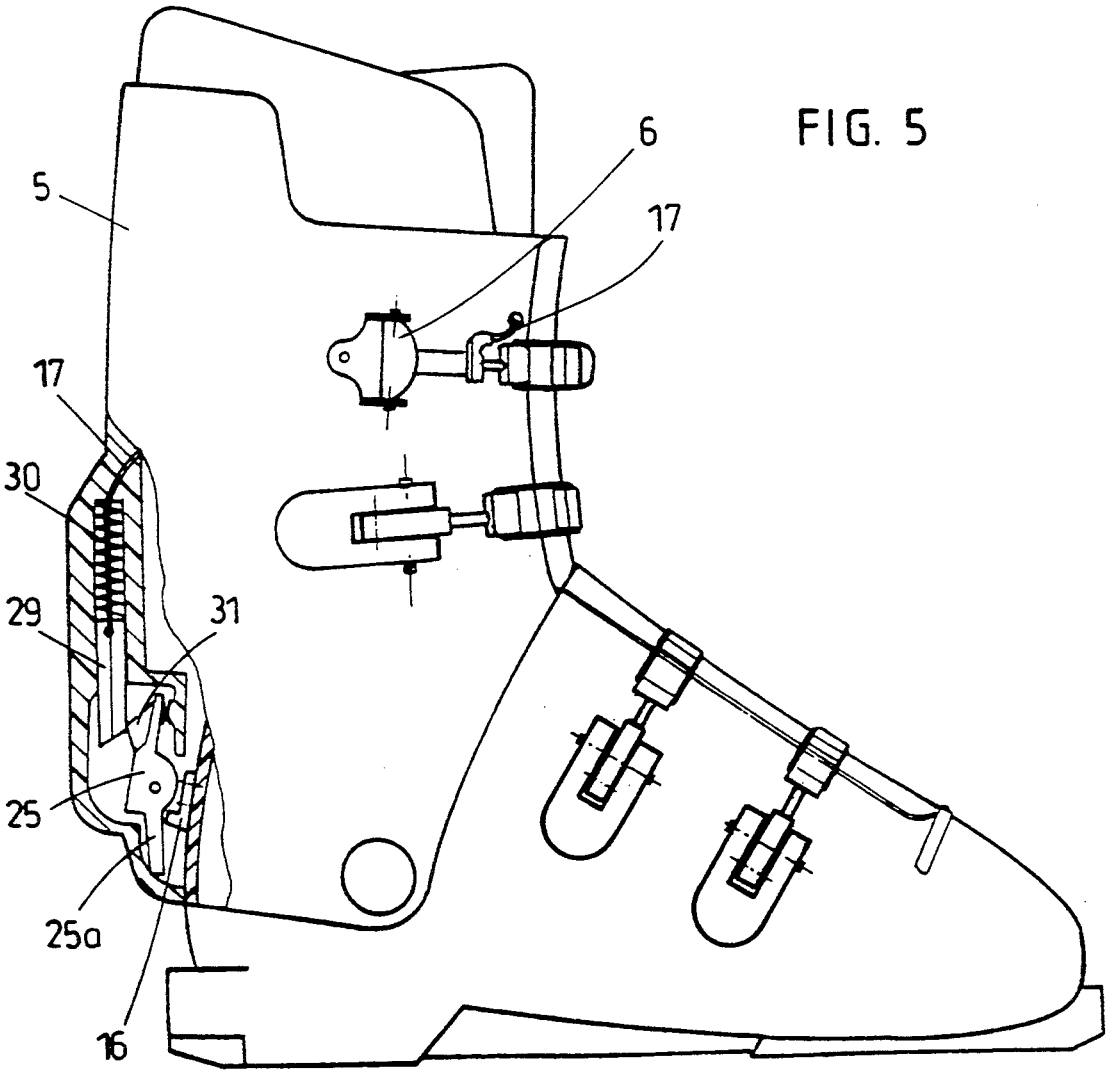
FIG. 5 represents the boot in FIG. 4, with the shaft freed.

This necessity of deforming the shaft in order to return to the locked position when the buckle 6 is closed in a straightened position of the shaft is eliminated in the second embodiment represented in FIGS. 4 and 5. In this embodiment, the back of the shaft 5 has a larger enlargement 23, the lower part of which enlargement delimits a housing 24, in which a rocker 25 is articulated about a transverse pin 26. As in the first embodiment, the lower arm 25*a* of this rocker interacts with a stop 16 which is fixed to the lower part 1 of the boot. This lower arm 25*a* is held in the engaged position by a spring 27 working under compression between the arm 25*b* of the rocker and an internal wall 28 of the housing 24 which forms part of the shaft 5. In the upper part of the enlargement 23, there is mounted a slider 29, to which one end of the cable 17 is attached. A spring 30 is compressed between the slider 29 and the bottom of the housing of this slider. In other respects, the boot is identical to the first embodiment.

In the closed clamped position of the shaft 5, the slider 29 is held back from the rocker 25 under the traction of the cable 17 and the shaft 5 is locked in the descent position by the rocker 25, as represented in FIG. 4.

When the skier opens the buckle 6, the relaxation of the cable 17 makes it possible for the spring 30 to push back the slider 29 which comes to act, like a cam, on a ramp 31 of the rocker 25. The latter rocks, compressing the spring 27, and its arm 25*a* moves away from the stop 16. The shaft 5 can straighten and oscillate freely.

Closing the buckle 6 frees the rocker 25 which readopts its locking position. If this freeing takes place in the straightened position represented in FIG. 5, the arm 25*a* of the rocker can pass over the edge of the stop 16 by pivoting as in the prior art.

Figure 8:
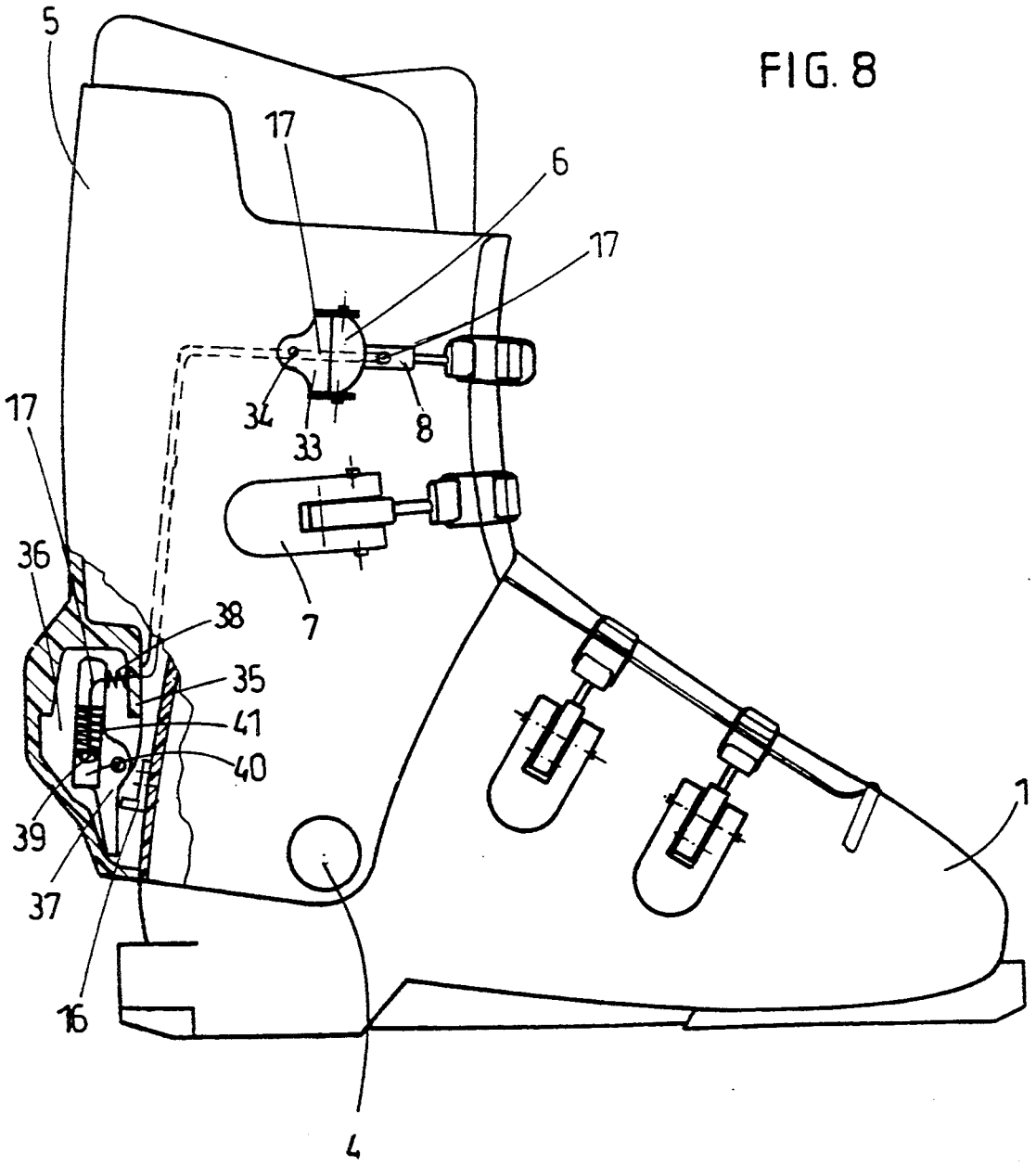
FIG. 8 represents the boot in FIG. 6, with the shaft freed.

A third embodiment is represented in FIGS. 6 to 8.

The essential parts of the boot, as well as the cable and its sheath, have been designated by the same references its sheath, have been designated by the same references as in FIGS. 1 to 5. This third embodiment differs essentially from the two previous embodiments in that the cable 17 is pulled by the buckle of the boot upon its opening instead of being relaxed. This makes it possible to produce a more compact embodiment which does not necessitate deformation of the boot in order to pass from the rest position to the descent position.

As is represented in FIG. 7, one of the ends of the cable 17 is fixed to the drawbar 8 of the uppermost buckle of the boot. To this end, the drawbar 8 is pierced by an oblique hole 32, in which the cable 17 is set. The cable 17 passes through the base plate 33 of the lever 6 via a hole 34 and then passes through the wall of the shaft 5 to penetrate into the sheath 19. At the other end of the sheath 19, the cable passes through an internal wall 35 of a housing 36 of the shaft, in which there is mounted a rocker 37 which interacts, like the previous rockers, with a stop 16 which is integral with the shell 1. The rocker 37 is held in engagement with the stop 16 by a spring 38 which surrounds the cable 17 and works under compression between the upper arm of the rocker 37 and the wall 35. The end of the cable 17 is provided with a head 39 which can slide in a housing 40 provided longitudinally in the rocker 37. A spring 41 works in compression between the cable head 39 and the bottom of the housing 40. The spring 41 has a force which is essentially lower than that of the spring 38.

The functioning of this third embodiment is as follows. In the closed position of the boot represented in FIG. 6, the cable 17 is relaxed and its head 39 is pushed back by the spring 41. The rocker 37 functions as a conventional catch under the action of its spring 38. When the uppermost buckle of the boot is unhooked, that is to say when the lever 6 is raised by rocking it forwards, its drawbar 8 exerts traction on the cable 17. This traction first has the effect, in a first part of the displacement of the cable, of compressing the spring 41 by the cable head 39. After total compression of the spring 41, the traction on the cable, in a second part of its displacement, has the effect of exerting traction on the upper arm of the rocker 37, compressing the spring 38. The rocker 37 is therefore moved away from the stop 16 and the shaft 5 can be righted as represented in FIG. 8.

When the skier again closes the uppermost buckle of the boot in the righted position of the shaft 5, the rocker 37 is freed by the cable 17 and rocks under the action of its spring 38. Upon the first bending of the skier, the lower nose of the rocker 37 passes over the stop 16, compressing the spring 38 and the shaft is again locked in the descent position.

As will be understood, the role of the spring 41 is to compensate the difference in the travels of the cable 17 and of the rocker 37, the latter being essentially smaller than the travel of the cable. The force of the spring 41, however, is chosen essentially smaller than that of the spring 38 in order to facilitate opening of the buckle.

The cable 17 could of course be fixed in any other manner to the buckle of the boot.

The three examples described are of course only two possibilities among numerous possibilities for acting on the rocker by means of a cable attached to a closing buckle.

In place of the slider 29, it would in particular be possible to use a lever bolt or an eccentric pivoting bolt associated with a spiral spring. Instead of acting on the upper arm of the rocker, the cable could act on its lower arm by means of a bolt or of a cam.

We claim:

1. A ski boot comprised of a lower part (1) surrounding the foot and the heel and of a shaft (5), in the form of a collar, which is articulated on the lower part provided withat least one closing buckle (6, 7) for clamping and loosening the boot comprising at the rear, a rocker (14; 25; 37), one of the arms of which interacts with a stop (16) which is integral with the lower part of the boot in order to hold the shaft in a descent position, inclined forwards, the rocker being articulated to means which is articulated to the at least one buckle so that when the at least one buckle is in a clamping position, the shaft is held in place by the interaction between the rocker and the stop so that when the at least one buckle is in a loosened position the shaft can oscillate about its articulation point by virtue of the relaxed tension on the means, thereby permitting the rocker to move away from the stop.

2. The ski boot as claimed in claim 1, which comprises a spring (22) which tends to hold said rocker (14) moved away from said stop (16) and wherein the means between the buckle and the rocker consist of a cable (17), one end of which is attached to the buckle and the other end of which is attached to the rocker, the traction of the cable on the rocker opposing the action of said spring.

3. The boot as claimed in claim 1, in which said closing buckle comprises a tensioning lever (6) provided with a drawbar (8) and a rocker spring (38) which holds the rocker (37) against said stop (16) in the manner of a catch, wherein the means between the buckle and the rocker comprise a cable (17) which penetrates to the inside of the rocker and one end of which is attached to said drawbar (8) and the other end of which is provided with a head (39) which bears against a spring (41) housed inside the rocker by means such that the cable is in a relaxed position when the buckle is in a closed position so that the head is pushed back by the force of the spring and the rocker spring exerts a force against the rocker, thereby holding the rocker in engagement with the stop, and when the buckle is in an open position the cable is in a tensioned position resulting in the head exerting a force thereby compressing the spring and exerting tension upon the rocker so that the rocker spring is compressed, resulting in the rocker moving away from the stop.

4. The boot as claimed in claim 1, wherein said means consist of a cable (17) mounted in a sheath (19) on the inside of the shaft of the boot.

5. A ski boot comprised of a lower part (1) surrounding the foot and the heel and of a shaft (5), in the form of a collar, which is articulated on the lower part provided with at least one closing buckle (6, 7) for clamping and loosening the boot comprising, at the rear, a rocker (14; 25; 37), one of the arms of which interacts with a stop (16) which is integral with the lower part of the boot in order to hold the shaft in a descent position, inclined forwards, the rocker being articulated to means which is articulated to the at least one buckle so that when the at least one buckle is in a clamping position, the shaft is held in place by the interaction between the rocker and the stop, and when the at least one buckle is in a loosened position the shaft can oscillate about its articulation point by virtue of the relaxed tension on the means, thereby permitting the rocker to move away from the stop, wherein a rocker spring (27) is provided which holds the rocker (25) against the stop (16) in the manner of a catch, wherein the means between the buckle and the rocker comprise a cable (17), one end of which is attached to the buckle, and a slider (29), pushed by a spring (30), to which the other end of the cable is attached, the slider and the rocker being arranged and oriented by means such that when the cable is relaxed by the buckle, the slider operates the rocker under the action of the spring.

6. A ski boot consisting of a lower part (1) surrounding the foot and the heel and of a shaft (5), in the form of a collar, which is articulated on the lower part provided with at least one closing buckle (6, 7) for clamping and loosening the boot comprising, at the rear, a rocker (14; 25; 37), one of the arms of which interacts with a stop (16) which is integral with the lower part of the boot in order to hold the shaft in a descent position, inclined forwards, the rocker being articulated to means which is articulated to the at least one buckle so that when the at least one buckle is in a clamping position, the shaft is held in place by the interaction between the rocker and the stop, and when the at least one buckle is in a loosened position the shaft can oscillate about is articulation point by virtue of the relaxed tension on the means, thereby permitting the rocker to move away from the stop, wherein the closing buckle comprises a tensioning lever (6) provided with a drawbar (8) and a rocker spring (38) which holds the rocker (37) against said stop (16) in the manner of a catch, wherein the means between the buckle and the rocker comprise a cable (17) which penetrates to the inside of the rocker and one end of which is attached to said drawbar (8) and the other end of which is provided with a head (39) which bears against a spring (41) housed inside the rocker by means such that the cable is in a relaxed position when the buckle is in a closed position so that the head is pushed back by the force of the spring and the rocker spring exerts a force against the rocker, thereby holding the rocker in engagement with the stop, and when the buckle is in an open position the cable is in a tensioned position resulting in the head exerting a force thereby compressing the spring and exerting tension upon the rocker so that the rocker spring is compressed, resulting in the rocker moving away from the stop and wherein the force of the spring (41) housed in the rocker is lower than the force of the rocker spring (38).

* * * * *